US006267024B1

(12) United States Patent
Hauguel

(10) Patent No.: US 6,267,024 B1
(45) Date of Patent: Jul. 31, 2001

(54) DEVICE ALLOWING A SYSTEM SUCH AS A MOTOR VEHICLE BRAKE BOOSTING SYSTEM TO BE CONTROLLED USING THE FOOT

(75) Inventor: Fabrice Hauguel, Beauchamp (FR)

(73) Assignee: Societe Financiere d'Etude et de Developpement Industriel et Technologique, Guyancourt (FR)

( * ) Notice: Subject to any disclaimer, the term of this patent is extended or adjusted under 35 U.S.C. 154(b) by 0 days.

(21) Appl. No.: 09/441,335

(22) Filed: Nov. 16, 1999

(51) Int. Cl.[7] ..... G05G 1/14
(52) U.S. Cl. ..... 74/512
(58) Field of Search ..... 74/512, 513, 514, 74/560

(56) References Cited

U.S. PATENT DOCUMENTS 6,151,985 * 11/2000 Garber et al. ..... 74/512
6,189,409 * 2/2001 Neag et al. ..... 74/512

FOREIGN PATENT DOCUMENTS

3427416 * 2/1986 (DE) ..... 74/512

* cited by examiner

*Primary Examiner*—Mary Ann Green
(74) *Attorney, Agent, or Firm*—Levine & Mandelbaum

(57) ABSTRACT

A device allowing a seated user to use his or her foot to control a member for actuating a system such as a motor vehicle brake boosting system, including a pedal articulated about an axis to a support that can be adjusted in terms of translation in the direction away from or closer to the user's seat. The pedal cooperates, via a sliding sleeve, with a rod which is itself articulated via levers to a carrying structure. The rod and the levers between them, and together with the pedal, constitute deformable parallelograms whatever the adjustment adopted for the axis of articulation of the pedal to its support, with respect to the carrying structure. The pivoting movement of the pedal is transmitted via one of the levers to a connecting rod which provides a link with the actuating member. Application particularly to adjusting the position of the pedal box of a motor vehicle, in terms of its distance from the driver's seat.

10 Claims, 4 Drawing Sheets

DEVICE ALLOWING A SYSTEM SUCH AS A MOTOR VEHICLE BRAKE BOOSTING SYSTEM TO BE CONTROLLED USING THE FOOT

BACKGROUND OF THE INVENTION

1. Field of the Invention

The present invention relates to a device for allowing a seated user to use his or her foot to control a member for actuating a system such as a motor vehicle brake boosting system, said device including a pedal located facing a seat for the user and articulated about an approximately horizontal first axis perpendicular to a direction joining the pedal to the seat, on a support that is mounted adjustably on a carrying structure which also carries the system and the seat, so as to allow the position of the first axis to be adjusted in terms of its distance from the seat, and a linkage connecting the pedal and the actuating member which linkage is articulated about axes parallel to the first axis so as to translate a pivoting movement of the pedal about the first axis with respect to the support into a corresponding displacement of the actuating member with respect to the system and into actuation of this system.

Although it may relate to any type of foot control, on any type of machine, by a seated user, it finds a particular application in the control of the boosted braking of a motor vehicle.

This is because it is known that the quest for optimum ergonomics in terms of the driving position of a motor vehicle, for reasons of comfort and safety, has led to the provision of possibilities for adapting the dimensional characteristics of the driving position to suit the build of the driver.

This adaptation is usually restricted to adjusting the position of the seat, with respect to the floor of the vehicle, in the lengthwise direction thereof, and possibly to adjusting the seat in a heightwise direction, and to adjusting the position of the steering wheel in one and/or other of these two directions, in addition to adjustments regarding the actual configuration of the seat itself.

2. Description of the Prior Art

However, it has recently been proposed that these possibilities for adaptation be supplemented by a means of adjusting the position of the pedal box, particularly the position of the brake pedal, in the lengthwise direction of the vehicle.

To this end, a device of the type mentioned in the preamble in which the support on which the pedal is articulated is itself articulated to a carrying structure, in practical terms to an element of the bodywork or of the chassis of the vehicle has been proposed, so that adjustment is achieved by pivoting the support.

This solution has the double disadvantage of the adjustment of the pedal in the lengthwise direction of the vehicle being accompanied by a variation in the level and orientation of the pedal with respect to the floor of said vehicle and of offering only a very restricted adjustment travel if the aforementioned drawback is not to have too pronounced, that is to say too troublesome, an effect.

SUMMARY OF THE INVENTION

The object of the present invention is to propose a device which overcomes these drawbacks, it being understood that even though this device has been more specifically designed for controlling a member for actuating a motor vehicle brake boosting system, it can be applied to any foot control, by a seated user, of a member for actuating any system.

To this end, the present invention proposes a device for allowing a seated user to use his or her foot to control a member for actuating a system such as a motor vehicle brake boosting system, the device including a pedal located facing a seat for the user and articulated about an approximately horizontal first axis perpendicular to a direction joining the pedal to the seat, on a support that is mounted adjustably on a carrying structure which also carries the system and the seat, so as to allow the position of the first axis to be adjusted in terms of its distance from the seat, and a linkage connecting the pedal and the actuating member, which linkage is articulated about axes parallel to the first axis so as to translate a pivoting movement of the pedal about the first axis with respect to the support into a corresponding displacement of the actuating member with respect to the system and into actuation of this system, wherein the support is mounted on the carrying structure so that it can be adjusted in terms of translation in said direction so that the first axis can be placed in several positions, in a determined plane, between two extreme positions which are respectively the position closest to and the position furthest away from the seat, while remaining perpendicular to said direction, and wherein said linkage includes:

- a first lever articulated to the carrying structure about a second axis located in said plane, between the extreme position closest to the seat and the latter, parallel to the first axis and having a free end,
- a second lever articulated to the carrying structure about a third axis located in said plane, further from the seat than the extreme position furthest from the latter, parallel to the first axis and having a free end,
- a straight rod articulated to the free ends of the first and second levers respectively at a fourth axis and a fifth axis, the fourth and fifth axes being parallel to the first axis, spaced apart by a distance that is the same as the distance separating the second and third axes from each other and the distance separating the fourth and second axes from each other being identical to the distance separating the fifth and third axes from each other so that the rod and the first and second levers define a deformable parallelogram with the carrying structure,
- a sleeve mounted so that it can slide along the rod and articulated to the pedal about a sixth axis parallel to the first axis and spaced from the latter by a distance that is equal to the distance separating the fourth and second axes from each other or separating the fifth and third axes from each other, and
- a connecting rod providing a link between one of the first and second levers and the actuating member, articulated to said lever about a seventh axis parallel to the first axis and offset respectively with respect to the second or third axis.

It will be readily understood that, if considering, for example, the application of the device to controlling the boosted braking of a motor vehicle, and once the plane of the first, second and third axes has been carefully oriented with respect to the floor of the vehicle, a device according to the invention allows any amount of adjustment travel, in the lengthwise direction of the vehicle, without any variation in the level and orientation of the pedal with respect to said floor, it being understood that this advantage is had irrespective of the envisaged application. The adjustment travel is in fact limited only by the space available for the device, and may be as much as several tens of centimeters, this allowing it to satisfy all needs.

Naturally, it could be anticipated for the seventh axis to coincide with the fourth or fifth axis, but it could also be anticipated for it to be offset with respect to these two axes, in terms of angle and/or in terms of distance from the second or third axis respectively, this making it possible to introduce a change of angle effect and/or a step-up or step-down effect between the pivoting movement of the pedal and the movement transmitted to the actuating member.

These two possibilities are compatible with articulating the linking connecting rod, about the seventh axis, on the free end of the first or of the second lever.

However, it is also possible to envisage for the first and second levers to be double and have a first respective branch articulated, on the one hand, to the carrying structure about the second or third axis respectively and, on the other hand, to the rod about the fourth or fifth axis respectively, and a second respective branch secured to the first branch at the second or third axis respectively, and having a free end defining an eighth or ninth axis respectively, the eighth and ninth axes being parallel to the first axis, spaced apart by a distance identical to the distance separating the second and third axes from each other and the distance separating the eighth and second axes from each other being identical to the distance separating the ninth and third axes from each other, for a connecting rod providing a coupling between the two levers to be articulated about the eighth and ninth axes to the free ends of the second branches to define a deformable parallelogram with the second branches of said levers and with the carrying structure, and for the connecting rod providing a link to be articulated about the seventh axis to the free end of the second branch of one of the first and second levers.

Even if it is desired to establish a change of angle effect and/or a step-up or step-down effect between the pivoting movement of the pedal and the effect applied to the actuating member, it is then possible to envisage for the seventh axis to be coincident with the eighth or ninth axis, respectively, insofar as it is possible to envisage for the eighth and ninth axes to the offset respectively with respect to the fourth and fifth axes.

This is because it will be seen that this offset may just as easily be either an offset in terms of respective distance from the second or third axis, or an angular offset about this second or third axis, which may make it easier for the entire device to be installed, according to the space available.

The device according to the invention thus offers a broad scope of possibilities for installations and a broad scope of possible uses.

It also has the advantage of being compatible with the two conventional methods of mounting articulated pedals, namely the so-called "floor-mounted" approach and the so-called "suspended" method of mounting. If the former of these approaches is to be taken, then provision is made for the fourth, fifth and sixth axes to be located above said plane and for the pedal to have a region acted upon by the user's foot that is located above the sixth axis and, if the latter of these approaches is to be adopted, provision is made for the fourth, fifth and sixth axes to be located below said plane and for the pedal to have a region acted upon by the user's foot that is below the sixth axis.

When the system controlled using a device according to the invention is a vehicle brake boosting system, it is advantageously anticipated for the support also to carry, articulated about tenth and eleventh axes parallel to the first axis or coincident with it, a throttle pedal and, as appropriate, a clutch pedal.

It will be noted that the throttle pedal and any clutch pedal there may be are traditionally connected to the members they control by a funicular transmission, generally by a BOWDEN cable, which does not give rise to the same difficulties, when adjusting the pedals in the lengthwise direction of the vehicle, as the articulated-linkage connection used for transmitting the movement of the brake pedal to the member for actuating the brake boosting system.

Naturally, a person skilled in the art will have no difficulty in designing means of adjusting the support in terms of translation with respect to the carrying structure, these means advantageously being produced in the form of remote-adjustment means made available to the user who will thus be able to make the adjustments while occupying a natural usage position, seated in his or her seat.

Other features and advantages of the device according to the invention will emerge from the description hereinbelow which relates to two non-limiting examples, and from the appended drawings which form an integral part of this description. It will be noted that these two examples relate to the control of the member for actuating a motor vehicle brake boosting system, but the person skilled in the art will readily understand that the arrangements described and illustrated can be read across directly to any other type of application.

DETAILED DESCRIPTION OF THE PREFERRED EMBODIMENTS

Figure 1:
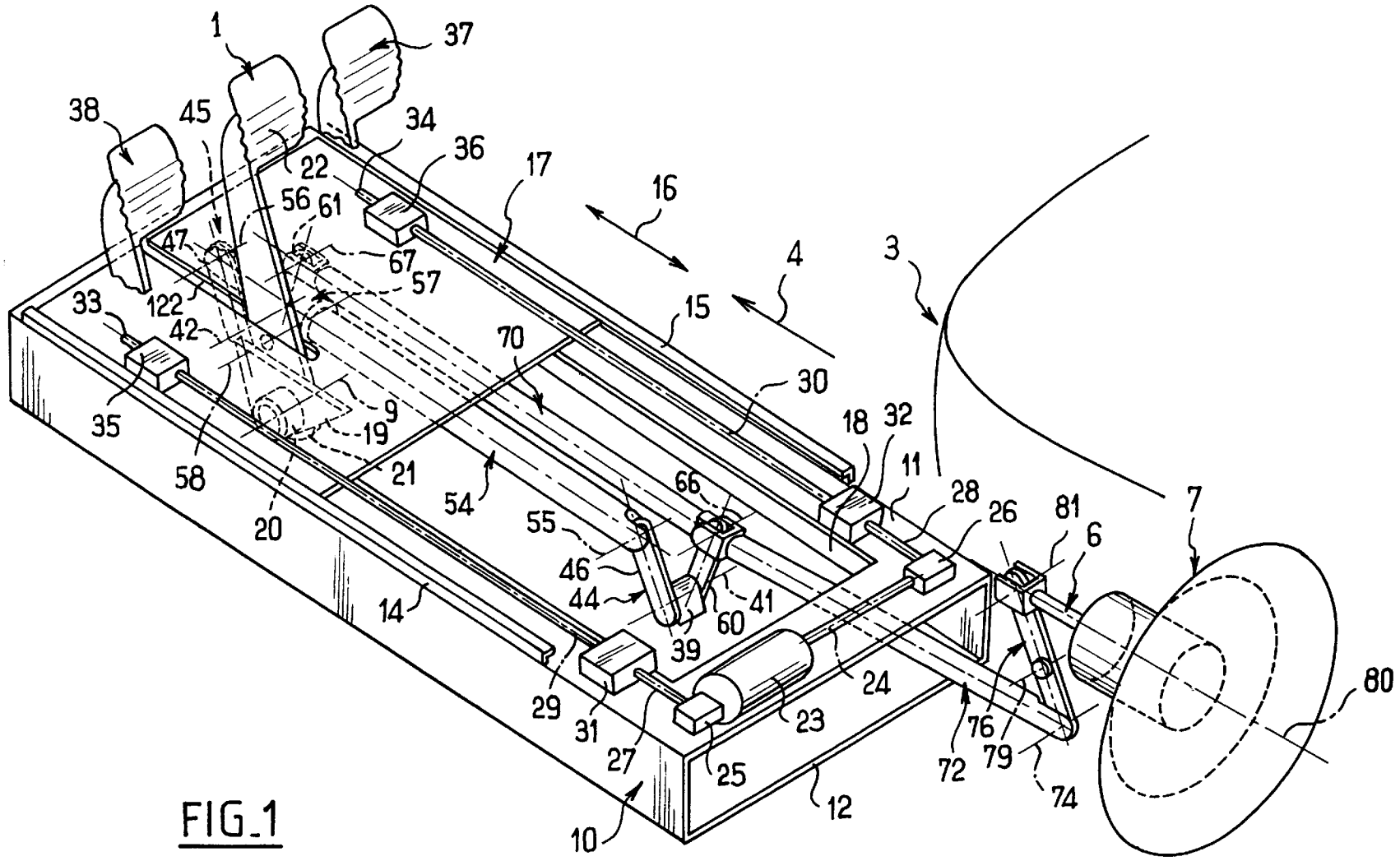
FIG. 1 illustrates, in a diagrammatic perspective view, one example of the mounting of a device according to the invention associated with a brake pedal articulated under the floor of the vehicle.
Figure 3:
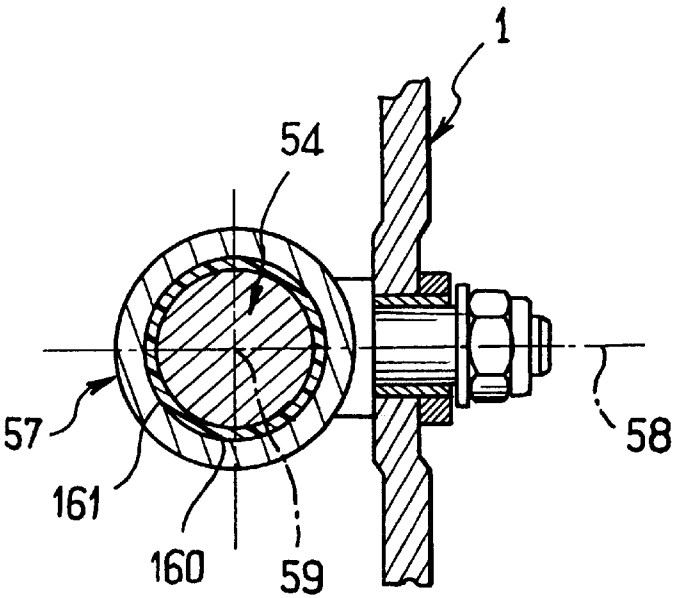
FIG. 3 shows the same detail as FIG. 2, in section on a plane perpendicular to the rod, passing through the sixth axis and labeled III—III in FIG. 2.
Figure 2:
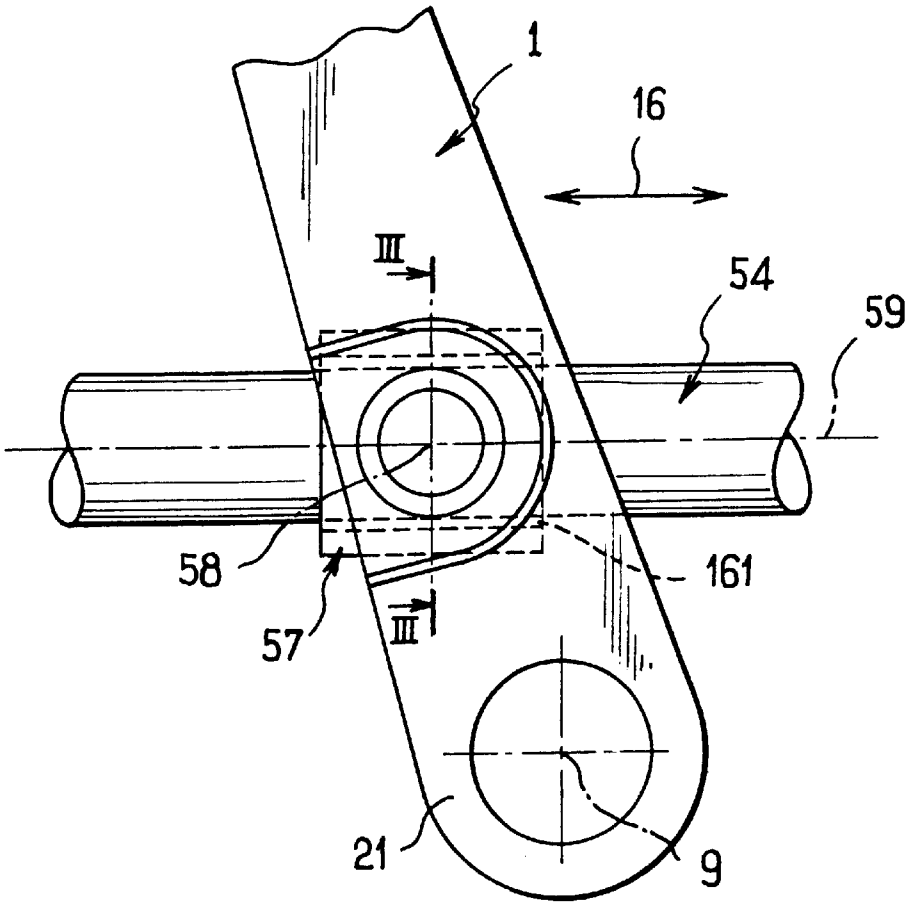
FIG. 2 illustrates, viewed in side elevation to a larger scale than FIG. 1, the details of the cooperation between the pedal and the rod connecting the two levers.

Reference is first of all made to the exemplary application of the invention illustrated in FIGS. 1 to 5, where 1 is used to denote a brake pedal, standing up from the floor 2 of the vehicle, forward of the driver's seat 3 when referring to a given direction 4 in which the vehicle is travelling forward, so that it can be acted upon by one of the driver's feet 5 in the direction that pivots it forward so as to control a backward sliding of a rod 6 constituting the member for actuating a servo-brake 7 located to the rear of the pedal 1. The rod 6 is mounted so that it can slide in a straight line in the servo-brake 7 along an axis 80 parallel to the direction 4 and has an unsupported actuation free end 78 projecting, forward, from the servo-brake 7 so that action, backward, on this end is translated into a movement whereby the rod 6 penetrates the servo-brake 7 and into a start or increase of braking action, and so that action subsequently applied to this end in a forward direction translates into a movement whereby the rod 6 emerges from the servo-brake 7 and into a reduction or cancellation of the braking action. The notions of forward and backward are understood here, as later, as being with reference to the direction 4 of forward travel of the vehicle.

For this purpose, in this example, the pedal 1 is articulated, under the floor 2 through which it passes through a slot 8, about an axis 9 perpendicular to an unreferenced longitudinal mid-plane of the vehicle, that is to say perpendicular to the direction 4 and horizontal when the vehicle is resting on horizontal ground. This axis 9 is stationary with respect to the floor 2 of the vehicle when the vehicle is in use, but its position in the direction 4 and in the opposite direction can be adjusted with respect to this floor 2, while at the same time retaining the same scope for the predetermined positioning of the rod 6 in terms of its sliding in the servo-brake 7 for a given inclination of the pedal 1 about the axis 9 with respect to the floor 2.

To do this, the mounting used for the pedal 1 is the one which will now be described.

A rigid cradle 10, for example a parallelepiped cradle, is mounted under the floor 2 so that it is secured to this floor or secured to constituent parts of the vehicle other than the floor 2 but which are secured to this floor, for example bodywork or chassis elements, thus forming an entity that is secured to the bearing structure of the vehicle, also carrying the servo-brake 71 mounted securely, and the seat 3, which is generally mounted so that it can be adjusted in the direction 4 and in the opposite direction.

The cradle 10 includes, in particular, in the example illustrated, a flat top wall 11, with cutouts to such a point that it is restricted to a surround, running alongside the floor 2 from underneath the latter, parallel to it, and a bottom wall 12 which is itself whole but which is also flat, parallel to the wall 11 and to the floor 2. It will be seen that as the floor 2 slopes upward slightly towards the front in the example illustrated, the walls 11 and 12 of the cradle 10 do likewise, but this inclination is at a small enough angle that the direction 4 can be retained as the forward-direction point of reference for describing the cradle 10 and the components it carries for applying the present invention.

Although it runs directly along the floor 2, the top wall 11 of the cradle 10 is faced away from this floor 2 by a uniform space 13 which is just deep enough for two slideways 14, 15 arranged respectively one on each side of the pedal 1, to be housed between the wall 11 and the floor 2, the slideways being mutually parallel and more specifically oriented in a direction 16 parallel to the floor 2 and to the two walls 11 and 12 of the cradle 10 and parallel, like the direction 4, to the unillustrated longitudinal mid-plane of the vehicle, that is to say perpendicular to the axis 9. It may be seen that the slot 8 formed in the floor 2 for the passage of the pedal 1 is made in this direction 16, which joins the pedal 1 to the seat 3 and constitutes the direction in which the device according to the invention allows the position of the axis 9 to be adjusted with respect to the floor 2, in terms of distance from the seat 3.

The two slideways 14, 15 bear, in sliding in the direction 16 on the top wall 11 of the cradle 10 with respect to this top wall 11, a rigid plate 17 which is thus housed between the top wall 11 of the cradle 10 and the floor 2, along which it runs, parallel thereto, which plate 17 bears, secured to it inside the cradle 10 through the cut-out 18 in the top wall 11 thereof and above the top wall 12, a mount 19 forming a bearing 20 of axis 9. Via this bearing, the mount 19 carries, with the possibility of relative rotation about the axis 9, an extreme lower region 21 of the pedal 1, which passes from the bottom upward first of all through the top wall 11 of the cradle 10, through the cut-out 18 in this top wall 11, then through the plate 17 via a slot 22 made therein in the direction 16 immediately below the slot 8, then through the floor 2 via the slot 8, so that the pedal 1 exhibits, above the floor 2, a top end region 22 in the shape of a paddle facing rearward, which constitutes the region of the pedal 1 which is acted upon by the driver's foot 5. When not acted upon, the pedal 1 occupies an extreme orientation illustrated in FIG. 4, in which it stands up above the floor 2 and the upper end region 22 occupies a rearward extreme position approximately vertically in line with the axis 9; this extreme orientation of the pedal 1 and this extreme rearward position of its upper end region 22, which correspond to the absence of action by the foot 5 on the pedal 1, also correspond to the absence of a braking action, the rod 6 then emerging from the servo-brake 7 by its maximum amount. If the foot 5 applies a forward action to the upper end region 22 of the pedal 1, this pedal can be pivoted forward, with the effect of increasingly heavy braking as the rod 6 is progressively driven into the servo-brake 7, until such time as the pedal 1 is brought into another extreme orientation in which it is illustrated in FIG. 5 and which corresponds to maximum penetration of the rod 6 into the servo-brake 7, that is to say maximum braking; in this extreme orientation, the pedal 1 is couched forward on the floor 2 and its upper end region 22 occupies a forward extreme position. Naturally, the size of the slot 22 and, given the possibilities offered by the present invention of adjusting the position of the axis 9, the dimension of the slot 8 in the direction 16 are compatible with this movement of the pedal 1 from one of its extreme orientations to the other regardless of the position of the axis 9 within the limits allowed by the device according to the invention.

Figure 4:
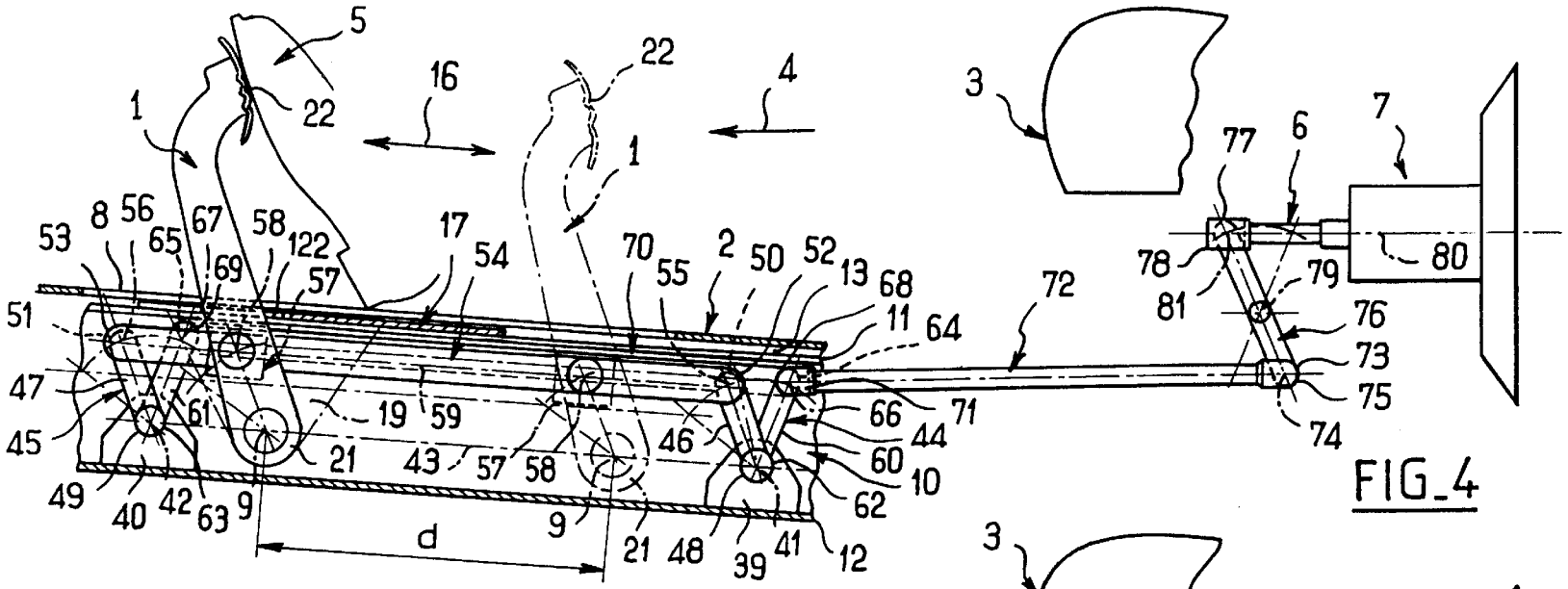
FIGS. 4 and 5 show a view in side elevation of the assembly illustrated in FIG. 1, respectively in the absence of actuation of the brake pedal and when this pedal is actuated.
Figure 5:
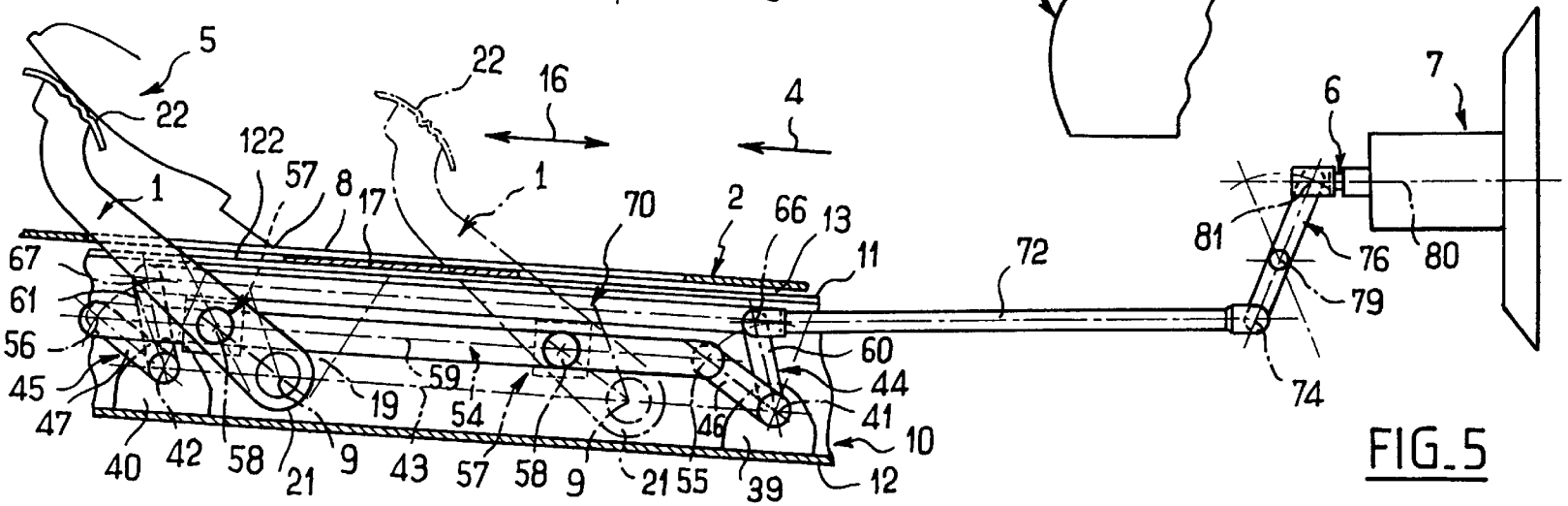

These extreme orientations of the pedal 1 are defined by stop means which are not illustrated but which are well known in themselves, for example associated with the mount 19 and the pedal 1 is returned from its extreme orientation illustrated in FIG. 5 to its extreme orientation illustrated in FIG. 4 by elastic return means acting, for example, between it and the mount 19, in a way which is not illustrated but is well known in itself, so that the release of the action applied in the forward direction by the foot 5 to the upper end region 22 of the pedal 1 is accompanied by an automatic return of this pedal to its extreme position illustrated in FIG. 4 and by a reduction followed by a disappearance of the braking effect.

It will be readily understood that the position of the axis 9 in the direction 16 inside the cradle 10 is directly related to the position of the plate 17 along the slideways 14 and 15.

In consequence, in order to allow the position of the axis 9 to be adjusted in the direction 16 means are provided for adjusting the position of the plate 17 along the slideways 14 and 15 and for immobilizing the plate 17 with respect to these slideways in any desired position of adjustment, between two limits which correspond, for the axis 9, to two extreme positions, respectively the forward extreme position illustrated in FIG. 1 and in solid line in FIGS. 4 and 5, and the rear extreme position illustrated in chain line in FIGS. 4 and 5. These two extreme positions, just like the distance d which separates them from each other in the direction parallel to the direction 16, can be chosen at will when implementing the present invention, within the limits of the space available for the device according to the invention, whose size in the direction 16 they govern. In particular, the distance d or maximum adjustment travel for the axis 9, may be as much as several tens of centimeters, but a value of the order of 15 to 25 cm, and for example of 18 cm is generally enough in this application, given the possibility of adjusting the position of the seat 3 in the direction 4 and in the opposite direction also; naturally, these figures are, however, mentioned merely by way of non-limiting example.

There are various means which may be provided for adjusting the position of the plate 17 along the slideways 14 and 15 but, according to the preferred embodiment illustrated in FIG. 1, these means are electrical, powered by the vehicle battery, and may be controlled remotely from the vehicle instrument panel, for example using a push-button, not depicted, of the type used for operating electric windows, so as to allow the plate 17 to be moved forward or backward at will with respect to the slideways 14 and 15 and so as to allow this movement to be stopped.

For this purpose, the top wall 11 of the cradle 10 carries, secured to it right towards the rear, at least partially projecting into the gap 13, an electric motor 23 which, in the gap 13, has two outputs with the same axis 24 parallel to the axis 9, each of these outputs being connected by reduction gearing 25, 26, forming an angle change of 90°, to a respective screw 27, 28 of axis 29, 30 parallel to the direction 16 and stationary with respect to the cradle 10, each of these screws 27, 28 being immobilized against a movement parallel to the direction 16 or perpendicular to this direction with respect to the cradle 10 but swiveling in a respective bearing 31, 32 secured to the top wall 11 of the cradle 10, inside the gap 13, and each running along a respective one of the slideways 14 and 15 between these slideways. Each of the screws 27, 28 thus extends as far as an unsupported free end 33, 34 inside the gap 13 above the top wall 11 of the cradle 10, passing over the plate 17. Coaxial with each of the screws 27, 28, this plate 17 carries, secured to it, inside the gap 13, a respective nut 35, 36 engaged with the appropriate screw so that the powering of the electric motor 23 so as to cause its outputs to rotate in either one direction or the other causes, by the rotation of the screws 27 and 28 in the one direction or in the other, a corresponding translational movement of the nuts 35 and 36 of the plate 17 either forward or backward. The design of the electrical power supply to the motor 23, of the reduction gearing 25 and 26, of the screws 27 and 28 and of the nuts 35 and 36 used for this is within the normal competence of the person skilled in the art. Likewise, it is within the normal competence of the latter to choose the pitch of the screws 27 and 28 and/or the step-down ratio of the reduction gearing 25 and 26 so that the transmission of movement between the motor 23 and the nuts 35, 36 is irreversible under normal conditions of use, that is to say that an appropriate supply of electricity to the motor 23 can cause the desired translation of the nuts 35 and 36 via the screws 27 and 28, but that a pushing or pulling force applied forward or backward to the plate 17 in the direction 16, and particularly the effect resulting from the thrust applied forward by the foot 5 to the top end region 22 of the pedal 1 is not able to result in a translation of the plate 17 when the motor 23 is not driven.

It may be seen that in addition to the brake pedal 1, the plate 17 may also carry, articulated about respective axes which are not illustrated and which may be coincident with the axis 9 or offset with respect to said axis while at the same time being parallel to it, an accelerator pedal 37 and, as appropriate, a clutch pedal 38 which pedal(s) may thus be adjusted, together with the brake pedal 1, in terms of distance from the seat 3; each of these pedals 37 and 38 may be mounted on the plate 17 in the way which is conventional, and therefore not illustrated, passing through the floor 2 through a respective slot parallel to the slot 8, and be connected also in the conventional way, not illustrated, for example by a funicular transmission to a throttle control member and to a clutch control member, respectively.

By contrast, means specific to the present invention are provided for connecting the pedal 1 to the rod 6 for actuating the servo-brake 7, and these means will now be described.

Inside the cradle 10, the bottom wall 12 thereof carries, secured to it, respectively to the rear of the rear extreme position of the axis 9 and to the front of the front extreme position thereof, a respective bearing 39, 40 defining a respective axis 41, 42 parallel to the axis 9 and located in one and the same plane 43 thereas, this plane 43 being parallel to the direction 16, perpendicular to the unillustrated longitudinal mid-plane of the vehicle, and located between the top 11 and bottom 12 walls of the cradle 10, closer to the bottom wall 12 than to the top wall 11. In all the positions that the axis 9 can occupy from one of its extreme positions to the other, the axes 41 and 42 are located respectively to the rear of and in front of the axis 9.

The two bearings 39 and 40 are located on one same side of the pedal 1, namely on the opposite side to the mount 19, with reference to an unreferenced direction defined by the axis 9, and each of them carries and guides, in rotation about the respective axis 41, 42 with respect to the cradle 10, a respective double lever 44, 45.

On that side of the bearings 39 and 40 which faces towards the pedal 1, between the respective bearing and this pedal, each lever 44, 45 has a first straight branch 46, 47, having a first end 48, 49 for articulation about the axis 41, 42 with respect to the associated bearing 39, 40 and a second end 50, 51 which is free, articulated to a respective free end 52, 53 of a straight rod 54 about a respective axis 55, 56 parallel to the axes 9, 41, 42. Under normal conditions of use, the rod 54 is arranged above the plane 43, between this plane and the top wall 11 of the cradle 10, and lies beside the pedal 1 on the same side thereof as the bearings 39 and 40, that is to say on the opposite side to the mount 19. It is oriented in the direction 16 and, for this purpose, between the axes 55 and 56 has a length equal to the distance separating the axes 41 and 42 in the direction 16, and the distance separating the axis 55 from the axis 41 is identical to the distance separating the axis 56 from the axis 42. It may be seen that, from the axis 41, 42, respectively, to its free end 50, 51, each branch 46, 47 is shorter than the distance separating the plane 43 from the top wall 11 of the cradle 10, so that, like the rod 54, the branches 46 and 47 of the levers 44 and 45 are always located under the top wall 11 of the cradle 10.

On the same side as the rod 54, the pedal 1 carries, between its lower end region 21 and the top wall 11 of the cradle 10 in any orientation of the pedal 1, from one of its aforementioned extreme orientations to the other, a sleeve 57 which is articulated to the pedal 1 about an axis 58 parallel to the axis 9 and located at a distance therefrom which is identical to the distance separating the axis 55 from the axis 41 or the axis 56 from the axis 42. The sleeve 57, free to pivot about the axis 58 with respect to the pedal 1 without any other possibility for relative displacement, is pierced right through, along an axis 59 perpendicular to the axis 58 and offset on the same side as the rod 54 with respect to the pedal 1, by a bore 60 which is cylindrical of revolution about the axis 59 and carries internally, secured to it, a bushing 61 for sliding engaged coaxially over the rod 54, so that the axis 59 which is therefore common to it intersects the axes 55 and 56 and so that, by means of the bushing 61, the sleeve 57 can slide along the rod 54 in the direction 16 when the position of the axis 9 is adjusted in this direction.

It may be seen that the rod 54, articulated about the axes 55 and 56 to the branches 46 and 47 of the levers 44 and 45, these branches 46 and 47, articulated about the axes 41 and 42 to the bearings 39 and 40, and the plane 43 passing through the axes 41 and 42 which are stationary with respect to the cradle 10 constitute a deformable parallelogram articulated about the axes 41, 42, 55, 56, and that the pedal 1, articulated to the mount 19 about the axis 9 located in the same plane 43 as the axes 41 and 42 and to the rod 54 about the axis 58 located in an unreferenced plane common to the axes 55 and 56, defines with the rod 54, the plane 43 and, respectively, one or other of the lever branches 46, 47, another deformable parallelogram, it being understood that on assembly, care is taken to orientate an unreferenced plane defined by the axes 9 and 58 parallel to unreferenced planes defined respectively by the axes 41 and 55 and by the axes 42 and 46, each of these unreferenced planes being, in practice, inclined upward at the front in a pronounced way when the pedal 1 occupies the extreme orientation illustrated in FIG. 4, and a less pronounced way when it occupies its extreme orientation illustrated in FIG. 5.

Thus, regardless of the position of the axis 9 between the axes 41 and 42, as a result of the distance between the pedal 1 and the seat 3 being adjusted, a rotation of the pedal 1 through a determined angle from the extreme orientation illustrated in FIG. 4, by pivoting about the axis 9 with respect to the mount 19, results in a rotational movement through the same angle, and in the same direction, of the branches 46 and 47 of the levers 44 and 45, that is to say of these levers 44 and 45 in their entirety. For reasons of geometry which will be readily understood by the person skilled in the art, the sleeve 57 cannot slide along the rod 54 during such pivoting, but on the other hand encounters no difficulty in sliding along the rod 54 when the position between the axis 9 and the seat 3 is being adjusted and this sliding does not in any way affect the deformable parallelogram structure described earlier nor does it lead to a change in orientation of the pedal 1 about its axis 9 or to a change in the level of the end 22 of the pedal 1 with respect to the floor 2 of the vehicle.

To allow it to transmit its pivoting movement to the rod 6, each lever 44, 45 has a second straight branch 60, 61 located on the opposite side of the respective bearing 39, 40 to the branch 46, 47. Each of the branches 60, 61 has one end 62, 63 for articulation to the bearing 39, 40 about the corresponding axis 41, 42, the end 62 being secured to the end 48 of the branch 46, while the end 63 is secured to the end 49 of the branch 67, through the bearings 39 and 40, respectively. Each branch 60, 61 also has a free end 64, 65 which itself defines a respective axis 66, 67 of articulation to a respective free end 68, 69 of a straight rod forming a coupling rod 70 parallel to the rod 54 and, like the latter, located between the plane 43 and the top wall 11 of the cradle 10 under normal conditions of use of the device. The distance separating the axes 66 and 67 from each other is identical to the distance separating the axes 41 and 42 from each other or alternatively separating the axes 55 and 56 from each other, and the distance separating the axis 66 from the axis 41 is identical to the distance separating the axis 67 from the axis 42 so that the connecting rod 70, the branches 60 and 61 of the levers 44, 45 and the plane 43 considered as being connected with the cradle 10 also define a deformable parallelogram. The length of the branches 60, 61 of the levers 44, 45 measured from the respective axis 41, 42 is shorter than the distance separating each of these axes from the top wall 11 of the cradle 10, which means that the connecting rod 70 just like the free ends 64, 65 of the branches 60, 61 are always located below the top wall 11 of the cradle 10 under normal conditions of use of the device.

The orientation of the branches 60, 61 of the levers 44, 45, defined, for example, by the orientation of an unreferenced plane passing through the axes 41 and 66 and of an unreferenced plane passing through the axes 42 and 67, may be different than that of the branches 46 or 47, or identical to it. In the example illustrated, if reference is made to the extreme orientation of the pedal 1 illustrated in FIG. 4, the branches 60 and 61 slope upward toward the rear with reference to the direction 4 whereas, in the orientation illustrated in FIG. 5, they slope upward toward the front with reference to this direction, although this example is not in any way restrictive.

It will be seen that the distance separating the axes 66 and 41 or the axes 67 and 42 may be identical to the distance separating the axes 55 and 41 or the axes 56 and 42 or be different than it, as is the case in the example illustrated in which this distance is greater so that the axes 66 and 67 effect a longer circumferential travel than the axes 55 and 56, with reference to the axis 41 or 42 respectively, for a pivoting of the pedal 1 through a given angle starting from its extreme orientation illustrated in FIG. 4.

A movement step-up effect or likewise a step-down effect or neutral effect can thus be applied between the pedal 1 and the free ends 64 and 65 of the branches 60 and 61 of the levers 44 and 45, particularly depending on the installation of the servo-brake 7, and on a need for matching between the permissible limiting travel of the rod 6 for controlling the servo-brake 7 and the pivoting travel available between the two extreme orientations of the pedal 1.

For this purpose, depending on the installation of the servo-brake 7 in the vehicle, articulated to the free end 65 of the branch 61 of the lever 45 about the axis 67, and this is not illustrated, or to the free end 64 of the branch 60 of the lever 44 about the axis 66, and which is illustrated, is a free front end 71 of a straight linking connecting rod 72 which lies approximately as a continuation of the connecting rod 70 which couples the two levers 44 and 45. The linking connecting rod 72, thus directed toward the rear from the axis 66 in the example illustrated, also has a free rear end 73 by which it is articulated, about an axis 74 parallel to the axis 66, to a free lower end 75 of a transmission lever 76 which also has a free upper end 77 in engagement with a free end 78 of the rod 6 of the servo-brake 7. Between these two free ends 75, 77, the lever 76 is articulated about an axis 79 parallel to the axis 74 on a component, not depicted, secured to the bearing structure of the vehicle and consisting, for example, of part of the bodywork thereof. While all the aforementioned pivoting movements occur about axes which are stationary with respect to the components which are articulated about them, the method of collaboration between the free end 77 of the lever 76 and the free end 78 of the rod 6 is an articulation about an axis 81 parallel to the axes 74 and 79 and coplanar with the latter, stationary with respect to the rod 6 but mobile with respect to the lever 76 in the direction toward or away from the axes 74 and 79 while remaining coplanar with these latter, according to an arrangement known to the person skilled in the art so that a pivoting of the lever 76 about the axis 79 with respect to the bearing structure of the vehicle through an angle that is determined by the angle of pivoting of the pedal 1 from its orientation illustrated in FIG. 4 causes a rectilinear translation of the rod 6 along the axis 80 toward the inside of the servo-brake 7, without the possibility of relative play along this axis 80 but with a possibility of relative play in an unreferenced direction perpendicular to the axes 74 and 79, in a way which is readily understandable to a person skilled in the art, in order to take account of the fact that the movement of the lever 76 is a rotational movement and that of the rod 6 is a translational movement. Thus, the travel of the rod 6 along the axis 80 in the direction of penetration into the servo-brake 7 and braking when the pedal 1 is pivoted from its orientation illustrated in FIG. 4 toward its orientation illustrated in FIG. 5, or out of the servo-brake 7, releasing the braking effect, when the pedal is allowed to return to its orientation illustrated in FIG. 4, occurs with an amplitude that is linked by a one-to-one relationship to the amplitude of the pivoting of the pedal 1, the position of the rod 6 along the axis 80 with respect to the servo-brake 7 being at every moment representative of the angular position of the pedal 1 about the axis 9. Naturally, it would not be departing from the scope of the present invention if each lever 44, 45 had just one branch 46, 47, that is to say if the second branches 60, 61 and the connecting rod 70 coupling them together were omitted and if the linking connecting rod 72 were articulated directly about an axis parallel to the axes 41 and 42, either directly about the axis 55 on the branch 46 or the axis 56 on the branch 47, or about an axis offset angularly and/or by a distance, with reference to the axis 41 or 42 respectively, on the branch 46 or the branch 47, in an arrangement that the person skilled in the art may easily deduce from the exemplary application of the invention which will now be described, with reference to FIG. 6.

This second example corresponds to a so-called "suspended" approach to mounting the pedal box of a motor vehicle, that is to say that the pedals hang down from the steering column, not depicted, instead of standing up from the floor.

There are, however, broad similarities between this embodiment and the one described with reference to FIGS. 1 to 5, which means that the same numerical references will be used to denote identical or similar elements.

This example again shows the servo-brake 7, its actuating rod 6 which can move in terms of translation with respect to it along a rectilinear axis 80, and the cradle 10, which, however, is then confined to a single wall similar to the top wall 11 of the cradle 10 described with reference to FIGS. 1 to 5, and which therefore also has the reference 11. This wall 11 is fastened securely to the bearing structure of the vehicle, or forms an integral part of this bearing structure, and is arranged under the steering column, not illustrated, perpendicularly to a longitudinal mid-plane, also not illustrated, of the vehicle and more specifically parallel to that region of the floor (the floor is not illustrated) thereof which lies directly forward of the driver's seat 3, with reference to a normal direction 4 in which the vehicle is travelling forward.

Like the top wall 11 of the cradle 10 described with reference to FIGS. 1 to 5, the wall 11 forming the cradle 10 in this example has a large cut-out 18 and bears secured to it, on each side of this cut-out 18, respectively two slideways 14, 15 which are identical to those described with reference to FIGS. 1 to 5 and which have a common direction 16 which is parallel both to the floor of the vehicle and to the longitudinal mid-plane thereof.

Likewise, the two slideways 14 and 15 serve to guide the translation in the direction 16 with respect to the wall 11 of a plate 17 resting on this wall 11, and the position of the plate 17 in sliding along the slideways 14, 15, that is to say in the direction 16, may be controlled by means 23 to 36 which in every respect are identical to those described with reference to FIGS. 1 to 5 and which are arranged, like the latter components, at least for the most part on top of the wall 11. These means in particular employ an electric motor 23 powered with electricity from the vehicle's on-board battery and controlled remotely from the vehicle's instrument panel so as to cause two lead screws 27, 28, which run respectively alongside the slideway 14 and alongside the slideway 15, between these slideways to rotate in one direction or the other, or to remain stationary, so that these screws cooperate with nuts 35, 36 borne securely by the plate 17, on top thereof.

From underneath, the plate 17 bears, secured to it, inside the cut-out 18, a clevis mount 82 defining, under the wall 11, an axis 83 perpendicular to the aforementioned longitudinal mid-plane of the vehicle, that is to say perpendicular to the direction 4 and to the direction 16 and horizontal when the vehicle is resting on a horizontal surface. The clevis mount 82 bears, so that it can rotate about the axis 83 with respect to the plate 17, an upper end region 84 of a brake pedal 85 placed facing the driver's seat 3 in the direction 16 and also having, at a level lower down than its upper end region 84, a lower end region 86 constituting its region which is acted upon by the driver's foot, not depicted. It can be seen that, like the plate 17 described with reference to FIGS. 1 to 5, the plate 17 of this embodiment may also bear, articulated about axes which are coincident with the axis 83 or parallel thereto, and suspended through the cut-out 18 in the wall 11, an accelerator pedal 87 and, possibly, a clutch pedal 88, which are mounted on the plate 17 and connected respectively to a throttle control and to a clutch control by conventional means known to the person skilled in the art and not illustrated.

Figure 6:
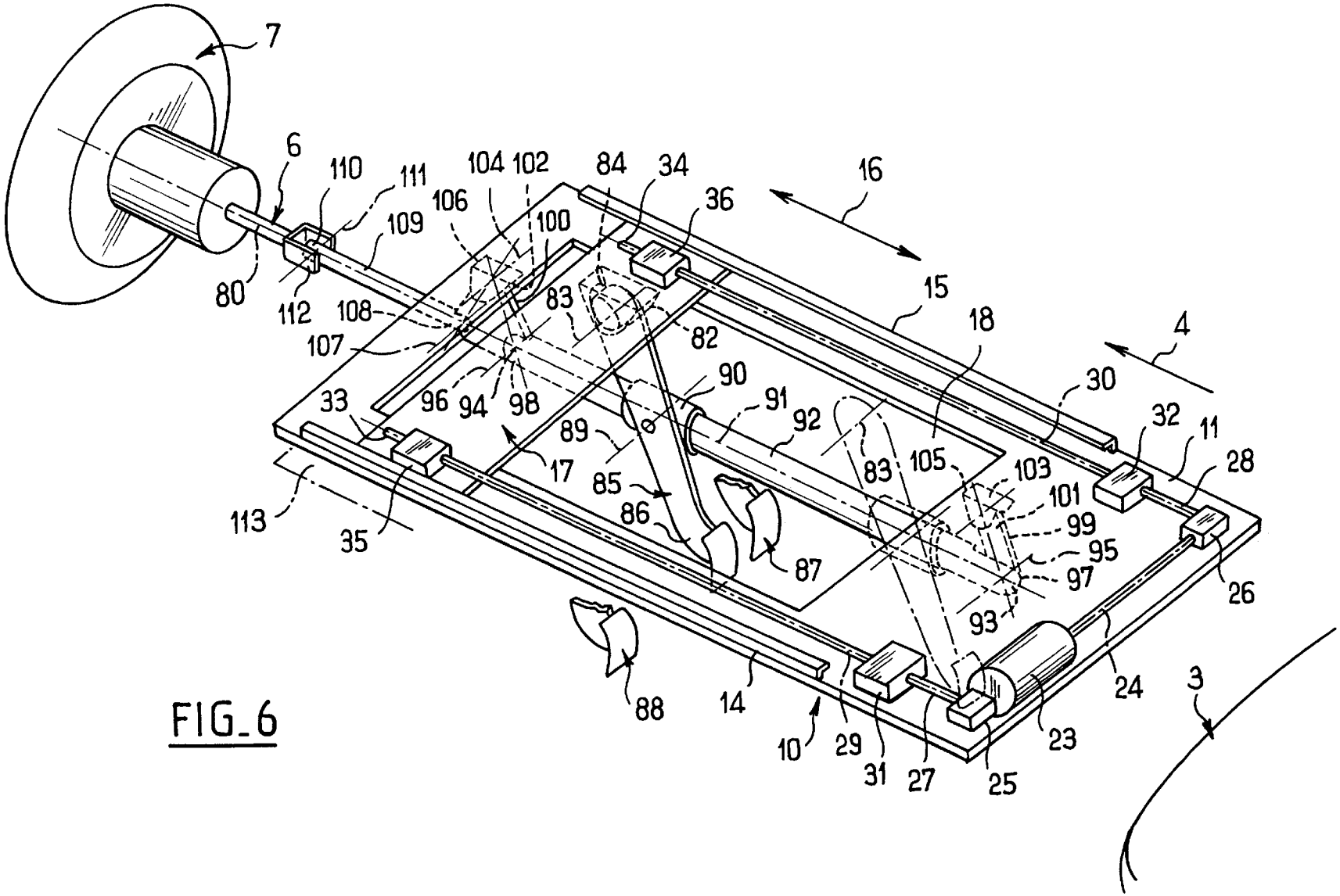
FIG. 6 illustrates, in a view similar to that of FIG. 1, an example of the mounting of a device according to the invention associated with a brake pedal suspended under the steering column (not illustrated).

Naturally, the size of the cut-out 18 in the direction 16 is such as to allow the position of the axis 83 to be adjusted in the direction 16 with respect to the cradle 10 and with respect to the entire bearing structure of the vehicle, between two predetermined extreme positions, namely a forward extreme position in which the pedal 85 is illustrated in solid line in FIG. 6, which is the position furthest from the driver's seat 3, and a rear extreme position illustrated in chain line in FIG. 6, which is the position closest to the driver's seat 3.

Between its two extreme regions 84 and 86, the pedal 85 bears, so that it can rotate about an axis 89 parallel to the axis 83 and located lower down than the latter, a sleeve 90 arranged beside the pedal 85 and having a construction which in every respect is similar to that of the sleeve 57. In particular, this sleeve 90 is pierced right through with an unreferenced bore of axis 91 perpendicular to the axis 89 and lined with a bushing, not illustrated, in which it receives, with the possibility of relative sliding along the axis 91 without any other possibility of relative displacement, a straight rod 92 arranged under the wall 11, in every respect similar to the rod 54 and guided, like the latter rod, in such a way as to allow the pedal 85 to pivot forward, about the axis 83, from an extreme orientation illustrated in solid line in FIG. 6, corresponding to the absence of action by the driver's foot and the absence of braking, and to a rear extreme position of the lower end region 86, into an unillustrated extreme orientation which corresponds to maximum braking and in which the lower end region 86 of the pedal 85 occupies a forward extreme position under the effect of action applied by the driver's foot, with elastic return from the extreme orientation for maximum braking into the extreme orientation for the absence of braking by elastic return means mounted in a way known to a person skilled in the art, while keeping the axis 91, common to the rod 92 and to the sleeve 90, parallel to the direction 16.

For this purpose, the rod 92 has a rear free end 93 and a front free end 94 which are articulated, about a respective axis 95, 96 parallel to the axis 89 located in one same unreferenced plane as these axes 95 and 96, on a free lower end 97, 98 of a respective lever 99, 100 which is also articulated, by an upper end 101, 102, about a respective axis 103, 104 parallel to the axis 83 with which the axes 103 and 104 are coplanar just as the axes 41 and 42 are coplanar with the axis 9, under a respective clevis mount 105, 106 fixed securely under the wall 11, respectively to the rear of the cut-out 18 and at the front thereof, that is to say respectively to the rear of the rear extreme position of the axis 83 and forward of the forward extreme position of the axis 83, within the limits of sliding of the plate 17 in the direction 16 of the wall 11. The distance separating the axes 95 and 96 is identical to the distance separating the axes 103 and 104, just as the distance separating the axes 103 and 93 is identical to the distance separating the axes 104 and 94 and to the distance separating the axes 83 and 89, which means that the levers 99 and 100, together with the rod 92 and the wall 11, or more specifically the plane 113 of the axes 103 and 104 which are stationary with respect to this wall, form a deformable parallelogram articulated about the axes 93, 96, 103, 104, and so that the pedal 85, appropriately orientated when mounting in such a way that a plane passing through the axes 89 and 83 is parallel to the planes passing respectively through the axes 95 and 103 and through the axes 96 and 104, itself forms a deformable parallelogram with the rod 92, the wall 11 to which the plate 17 is secured once any adjustment has been made, or more specifically the plane 113 containing not only the axes 103 and 104 but also the axis 85, and each of the levers 99 and 100 respectively.

In order to provide a kinematic link between the pedal 86 and the rod 6 of the servo-brake 7, the lever 99, and this is not illustrated, or the lever 100, and this is illustrated, is articulated about an axis 107 parallel to the axis 106 and which may be coincident with the axis 96, and this is not illustrated, or offset with respect to this axis away from the axis 104 and/or at an angle, as is illustrated, on a free rear end 108 of a straight linking connecting rod 109 extending forward from this free end 108 as far as a second free end or front end 110 articulated about an axis 111 parallel to the axis 109 in a clevis mount 112 secured to the rod 6 of the servo-brake 7.

It will be readily understood that a pivoting of the pedal 85 from its extreme orientation for the absence of action and absence of braking results directly in a thrust applied, via the lever 100, possibly with a step-up or step-down effect, the linking connecting rod 109 and the clevis mount 112, to the rod 6 in the direction of a translation toward the inside of the servo-brake 7, placed forward of this rod 6, with a translational travel of the rod 6 which is representative of the pivoting travel imparted to the pedal 85, the sleeve 90 behaving as if it were as one with the rod 92 during pivoting of the pedal 85. Likewise, the return of this pedal to its position for the absence of action results in the rod 6 re-emerging from the servo-brake 7, and the configuration is such that at every moment the position of the rod 6 is representative of that of the pedal 86 in terms of orientation about the axis 83 with respect to the plate 17 and with respect to the wall 11, and that this is the case irrespective of the position of the axis 83 between the front and rear extreme positions obtained by adjusting the position of the plate 17 in the direction 16 with respect to the wall 11. By contrast, the sleeve 90, capable of sliding along the rod 92, does not oppose this adjusting of the position of the axis 83.

In this respect, reference is made to the explanations given with regard to FIGS. 1 to 5, which can be read across directly to this embodiment.

Naturally, the two examples which have just been described are not in any way limiting, and numerous alternative forms may be envisaged without in any way departing from the scope of the present invention. In particular, in the case of the suspended pedal, a double-lever arrangement similar to the one described with reference to FIGS. 1 to 5 could be adopted, each of the levers 99 and 100 being replaced by a double lever similar to the levers 44 and 45, one branch of which would be connected to the rod 92 and the other branch of which would be connected to a coupling connecting rod which, together with the respective branches of the levers and the plate 11, would form a deformable parallelogram, the connecting rod 109 then being articulated to that one of the branches of one of the levers which is connected to this coupling connecting rod.

Furthermore, depending on the installation of the servo-brake 7, it would be possible to use a direct connection between the connecting rod 72 and the rod of this servo-brake, with reference to the example illustrated in FIGS. 1 to 5, in the manner described with reference to FIG. 6, just as it would be possible to provide an indirect connection, similar to what was described with reference to FIGS. 1 to 5, in a setup which in other respects was similar to the one described with reference to FIG. 6.

Likewise, the device according to the invention could be adapted to areas of application other than that of the control of the braking of a motor vehicle without in any way departing from the scope of the invention.

What is claimed is:

1. A device for allowing a seated user to use his or her foot to control a member for actuating a system such as a motor vehicle brake boosting system, said device including a pedal located facing a seat for said user and articulated about an approximately horizontal first axis perpendicular to a direction joining said pedal to said seat, on a support that is mounted adjustably on a carrying structure which also carries said system and said seat, so as to allow the position of said first axis to be adjusted in terms of its distance from said seat, and a linkage connecting said pedal and said actuating member, which linkage is articulated about axes parallel to said first axis so as to translate a pivoting movement of said pedal about said first axis with respect to said support into a corresponding displacement of said actuating member with respect to said system and into actuation of said system, wherein said support is mounted on said carrying structure so that it can be adjusted in terms of translation in said direction so that said first axis can be placed in several positions, in a determined plane, between two extreme positions which are respectively the position closest to and the position furthest away from said seat, while remaining perpendicular to said direction, and wherein said linkage includes:

a first lever articulated to said carrying structure about a second axis located in said plane, between said extreme position closest to said seat and the latter, parallel to said first axis and having a free end, a second lever articulated to said carrying structure about a third axis located in said plane, further from said seat than said extreme position furthest from the latter, parallel to said first axis and having a free end, a straight rod articulated to the free ends of said first and second levers respectively at a fourth axis and a fifth axis, said fourth and fifth axes being parallel to said first axis, spaced apart by a distance that is the same as the distance separating said second and third axes from each other and the distance separating said fourth and second axes from each other being identical to the distance separating said fifth and third axes from each other so that said rod and said first and second levers define a deformable parallelogram with said carrying structure, a sleeve mounted so that it can slide along said rod and articulated to said pedal about a sixth axis parallel to said first axis and spaced from the latter by a distance that is equal to the distance separating said fourth and second axes from each other or separating said fifth and third axes from each other, and a connecting rod providing a link between one of said first and second levers and said actuating member, articulated to said lever about a seventh axis parallel to said first axis and offset respectively with respect to said second or third axis.

2. The device claimed in claim 1, wherein said seventh axis is offset with respect to said fourth and fifth axes.

3. The device claimed in claim 1, wherein said connecting rod is articulated about said seventh axis on the free end of said first or second lever.

4. The device claimed in claim 1, wherein said first and second levers are double and have a respective first branch articulated, on the one hand, to said carrying structure about said second or third axis respectively and, on the other hand, to said rod about said fourth or fifth axis respectively, and a respective second branch secured to said first branch at said second or third axis respectively, and having a free end defining an eighth or ninth axis respectively, said eighth and ninth axes being parallel to said first axis, spaced apart by a distance identical to the distance separating said second and third axes from each other and the distance separating said eighth and second axes from each other being identical to the distance separating said ninth and third axes from each other, a connecting rod providing a coupling between said two levers is articulated about said eighth and ninth axes to the free ends of said second branches and defines a deformable parallelogram with said second branches of said levers and with said carrying structure, and said connecting rod providing a link is articulated about said seventh axis to the free end of said second branch of one of said first and second levers.

5. The device claimed in claim 4, wherein said seventh axis is coincident with said eighth or ninth axis.

6. The device claimed in claim 4, wherein said eighth and ninth axes are respectively offset with respect to said fourth and fifth axes.

7. The device claimed in claim 1, wherein said fourth, fifth and sixth axes are located above said plane and said pedal has a region which is acted upon by the user's foot located above said sixth axis.

8. The device claimed in claim 1, wherein said fourth, fifth and sixth axes are located below said plane and said pedal has a region which is acted upon by the user's foot located below said sixth axis.

9. The device claimed in claim 1, wherein said system is a brake boosting system and said support also carries, articulated about said second and eleventh axes parallel to said first axis or coincident with it, a throttle pedal and, as appropriate, a clutch pedal.

10. A device as claimed in claim 1, which includes means for remotely adjusting said support in terms of translation with respect to said carrying structure.

* * * * *